US007248710B2

(12) United States Patent
Roeck

(10) Patent No.: US 7,248,710 B2
(45) Date of Patent: Jul. 24, 2007

(54) EMBEDDED INTERNET FOR HEARING AIDS

(75) Inventor: Hans-Ueli Roeck, Hombrechtikon (CH)

(73) Assignee: Phonak AG, Stafa (CH)

( * ) Notice: Subject to any disclaimer, the term of this patent is extended or adjusted under 35 U.S.C. 154(b) by 431 days.

(21) Appl. No.: 10/772,605

(22) Filed: Feb. 5, 2004

(65) Prior Publication Data

US 2005/0175199 A1 Aug. 11, 2005

(51) Int. Cl.
*H04R 25/00* (2006.01)

(52) U.S. Cl. ..... 381/312; 381/320

(58) Field of Classification Search ..... 381/313, 381/316, 320, 321, 60, 315
See application file for complete search history.

(56) References Cited

U.S. PATENT DOCUMENTS

| | | | | |
|---|---|---|---|---|
| 4,508,940 | A * | 4/1985 | Steeger | 381/317 |
| 4,879,749 | A * | 11/1989 | Levitt et al. | 381/318 |
| 4,887,299 | A | 12/1989 | Cummins | |
| 5,524,056 | A * | 6/1996 | Killion et al. | 381/312 |
| 5,671,287 | A | 9/1997 | Gerzon | |
| 6,310,556 | B1 | 10/2001 | Green et al. | 340/636.15 |
| 7,200,237 | B2 | 4/2007 | Zhang et al. | 381/60 |
| 2003/0091197 | A1 * | 5/2003 | Roeck et al. | 381/314 |

FOREIGN PATENT DOCUMENTS

| | | | |
|---|---|---|---|
| WO | 01/20965 | A2 | 3/2001 |
| WO | 01/20965 | A3 | 3/2001 |
| WO | WO 02/05591 | A2 * | 1/2002 |

OTHER PUBLICATIONS

Haas H: "The Influence of a Single Echo on the Audibility of Speech", Journal of the Audio Engineering Society, Audio Engineering Society. New York, US, vol. 20, No. 2, Mar. 1972, pp. 146-159, XP000795809, ISN: 0004-7554.

* cited by examiner

*Primary Examiner*—Daniel Swerdlow
(74) *Attorney, Agent, or Firm*—Pearne & Gordon LLP

(57) ABSTRACT

A method is described to operate a hearing device with an input transducer (1), a signal processing unit (2) and an output transducer (4). The method comprises the steps of converting an acoustic input signal into a converted input signal, processing the converted input signal in a main signal path in order to obtain a main output signal, and supplying the main output signal to an output transducer. By processing the converted input signal in a side signal path to obtain a side path output signal, and by superimposing the side path output signal on the main output signal, wherein a group delay of a signal traveling through the side signal path is smaller than a group delay of a signal traveling through the main signal path, the localization problems are eliminated. At the same time, the hearing device according to the present invention can still have a very high performance. In short terms, a "zero-delay-high-performance" hearing device has been created by the present invention.

16 Claims, 3 Drawing Sheets

EMBEDDED INTERNET FOR HEARING AIDS

FIELD OF THE INVENTION

The present invention is related to a method to operate a hearing device as well as to a hearing device.

BACKGROUND OF THE INVENTION

Digital hearing devices can be divided up into two classes: Those applying algorithms in the frequency-domain and those applying algorithms in the time-domain. In the first-mentioned class, a transformation from the time domain into the frequency domain must be performed of a signal to be processed, as for example by a Fast Fourier Transformation (FFT). Thereafter, a frequency-domain filter bank is used to process the signal in several frequency bands. Usually, the number of frequency bands used is rather high. In contrast thereto, no transformation takes place in the second-mentioned class but a direct processing is performed of an input signal in the time domain using time-domain filter banks. Usually, the number of frequency bands, in which the time-domain filter banks are applied, is clearly lower. Time-domain filter banks are also characterized in that they usually process the input signal either sample-by-sample or in analog domain, whereas frequency-domain filter banks or transformation-based filter banks, respectively, usually process a number of samples at a time in a block, a so-called frame. The time required to buffer the samples for such a block of data adds to the higher group delay inherent for transformation-based filter banks.

Those hearing devices with time-domain filter bank algorithms tend to be a lot simpler and have rather low power consumption. On the other hand, the frequency-domain filter bank algorithms allow a much higher performance. Unfortunately, the frequency-domain algorithms possess greater groups delay than the time-domain algorithms. The term "group delay" is defined as the delay of a signal wave front by processing steps in comparison with the unprocessed signal. Therefore, an unprocessed signal is delay less. While hearing devices with time-domain filter bank algorithms usually possess a group delay of 0.5 to 2 ms, the frequency-domain filter bank algorithms may have group delays of 5 to 10 ms. Examples for corresponding commercially available products are CLARO of the company Phonak AG, NEXUS of the company Unitron Inc. and CANTA7 of the company GN Resound.

The higher group delay for frequency-domain filter bank algorithms is very often considered as a problem for hearing device user. Although many studies show that the awareness of a delay in a hearing device increases only gradually between 1 and approximately 12 ms, it is generally noted that less delay is better.

It has been found for hearing devices that this delay has two main influences:

For similar transfer functions of the processed delayed signal and the unprocessed signal—which is delay-less according to the afore-mentioned definition—through bone conduction or through the vent, respectively, there will be a comb filter effect which will change the perceived timbre of especially the hearing device user's own voice. This comb filter effect, which is basically only a magnitude function, though will be extremely difficult to distinguish from the far more severe effect of the transfer function of the receiver, i.e. the loudspeaker of the hearing device.

Introducing a delay will generate a localization problem for the hearing device user, especially in monaural fittings.

Due to the severe effect of the receiver upon the transfer function of the overall hearing device, and the significance of the comb filter effect only for low gains, it can be neglected safely. Localization problems are to be taken serious though.

It is therefore an object of the present invention to provide a method to operate a hearing device with a high performance which does not have the above-mentioned drawbacks.

SUMMARY OF THE INVENTION

This object is obtained by a method to operate a hearing device with an input transducer, a signal processing unit and an output transducer, the method comprising the steps of converting an acoustic input signal into a converted input signal, processing the converted input signal in a main signal path in order to obtain a main output signal, supplying the main output signal to an output transducer, processing the converted input signal in a side signal path to obtain a side path output signal, and superimposing the side path output signal on the main output signal, wherein a group delay of a signal traveling through the side signal path is smaller than a group delay of a signal traveling through the main signal path.

The present invention has the following advantages: By processing the input signal in a side signal path to obtain a side path output signal and by superimposing the side path output signal to the output signal of the main signal path, wherein a group delay of a signal traveling through the side signal path is smaller than a group delay of a signal traveling through the main signal path, the localization problems are eliminated. At the same time, the hearing device according to the present invention can still have a very high performance. In short terms, a "zero-delay-high-performance" hearing device has been created by the present invention.

From psychoacoustics, we know that the human auditory cortex is using only the first wave front of a transient to determine the perceived direction-of-arrival (DOA) of a certain sound. Reflections of room walls, which could mislead the brain, get neglected, i.e. we are used to the fact, that delayed versions (reflections) of a sound get mixed with the original signal and do not perceive them separately anymore. This effect of using only the first wave front is also known as "precedence" effect. For further information regarding the precedence effect which is also called "law of the first wave front", reference is made to the publication of E. Zwicker and H. Fastl entitled "Psychoacoustics—Facts and Models" (2nd edition, Springer-Verlag Berlin Heidelberg New York, 1999, pp. 78, 82 and 311).

Knowing also that transients, used for localization, possess a reasonably high signal-to-noise level (SNR) over the mean background noise level, the method according to the present invention makes it possible to reproduce the correct localization result without throwing away the benefits of an algorithm applied in the frequency domain, e.g. an FFT-based algorithm.

According to the present invention, a side signal path, having a smaller group delay than the main signal path, is switched in parallel to the main signal path. The gain of the side signal path is thereby not higher than the gain in the main signal path, i.e. the gain generated by the frequency-domain filter bank.

BRIEF DESCRIPTION OF THE DRAWINGS

In the following, the present invention is described by referring to drawings which show several exemplified embodiments of the present invention, whereas it is shown in.

DETAILED DESCRIPTION OF SEVERAL EMBODIMENTS

Figure 1:
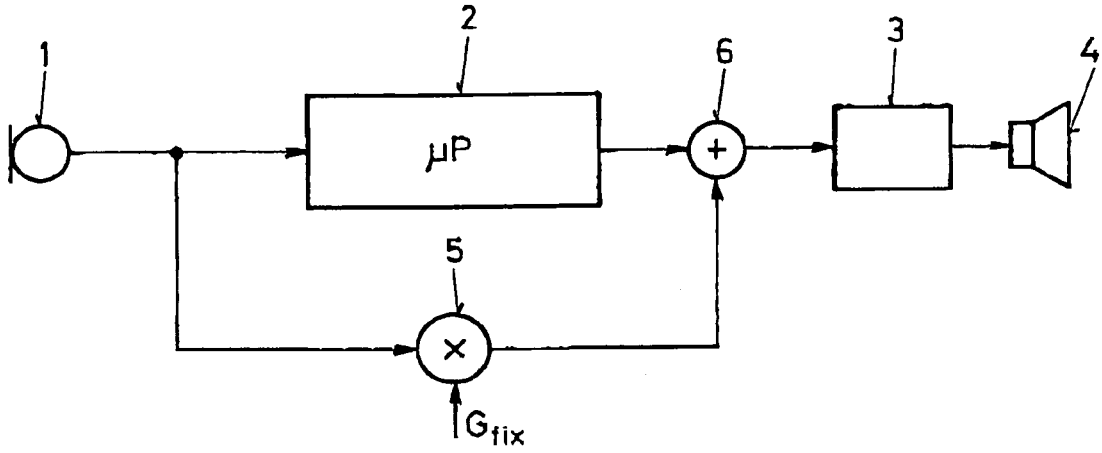
FIG. 1, schematically, a block diagram of a hearing device having a main signal path and a side signal path according to the present invention, FIG. 2, again schematically, a block diagram of a further embodiment of the hearing device according to the present invention, FIG. 3 a plot of a curve showing gain of the main and the side signal path as a function of an input level for a severe hearing loss, FIG. 4 a plot of a curve showing gain of the main and the side signal path as a function of an input level for a mild hearing loss, and FIG. 5, yet another embodiment of the present invention, schematically shown in a block diagram of a hearing device having more than one side signal path.

In FIG. 1, a block diagram of a hearing device according to the present invention is depicted. An acoustic signal is picked-up by an input transducer 1, e.g. a microphone, by which an electrical signal is generated from the acoustic signal. As this invention is particularly directed to a digital hearing device, an analog-to-digital converter must be provided to convert the analog output signal of the input transducer 1 into a digital signal. Having said this, it is pointed out that the present invention is not only directed to digital hearing devices but is very well suitable to be implemented in analog hearing devices without leaving the scope of the present invention. Obviously, the analog-to-digital converter is not necessary for analog hearing devices.

As it is shown in FIG. 1, the block diagram generally consists of two forward signal paths, the first being called main signal path and the second being called side signal path. The main signal path comprises a signal processing unit 2 and concludes with an adder unit 6 which unite the two signal paths. The side signal path comprises a gain unit 5 which is, on its output side, connected to the adder unit 6.

In the signal processing unit 2 of the main signal path, the output signal of the input transducer 1 or the analog-to-digital converter, respectively, is processed according to rules and demands generally known in hearing device technology. This particularly includes the use of a number of different hearing programs for specific acoustic situation, the automatic selection of a best suitable hearing program, preferably by using classifiers as disclosed in WO 01/20 965, for example.

As has been explained above, the use of frequency-domain filter bank algorithms in the main signal path is superior regarding flexibility and quality of the obtained results in comparison with the use of time-domain filter bank algorithms. Nevertheless, an implementation of frequency-domain filter bank algorithms result in rather high group delays due to extensive calculations in the processing unit 2, i.e. in the main signal path.

The side signal path, as it is proposed by the present invention and as it is depicted in FIG. 1, contains no filter bank and thus there is no group delay for a signal through this side signal path. Because of complete absence of a filter bank in the side signal path, there is not even a low group delay as must be dealt with when using a time domain filter bank. A gain applied in the side signal path by the gain unit 5 is in a simple embodiment of the present invention as depicted in FIG. 1 a preset value $G_{fix}$.

In one embodiment of the present invention, the gain is adjusted in the side signal path such that on overall gain from the input transducer 1 through the side signal path to an output transducer 4 is approximately equal to one.

Figure 2:
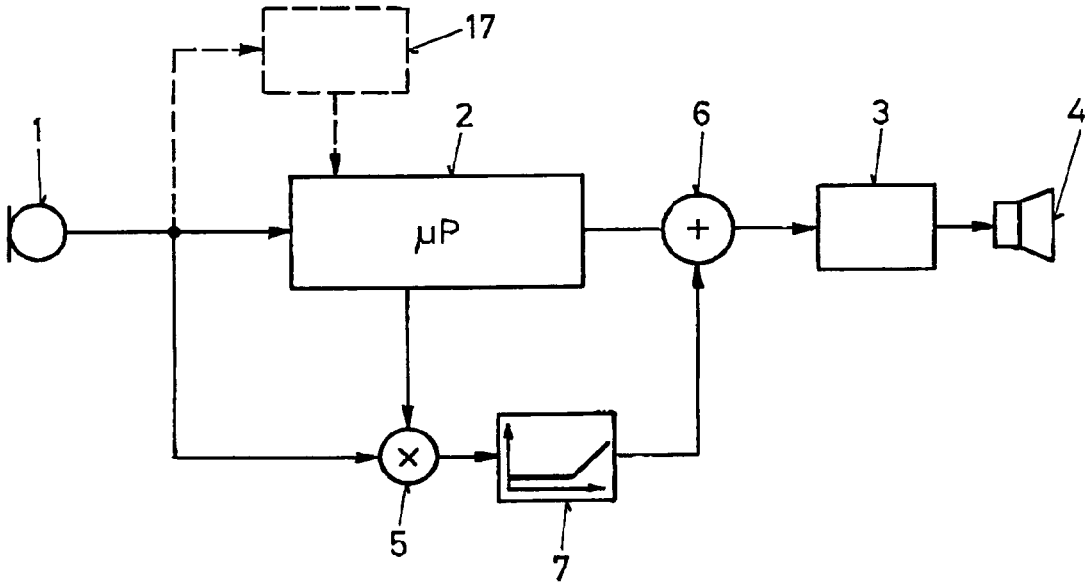

In a further embodiment which is superior in comparison with the just mentioned and which is shown in FIG. 2, the gain is computed from an existing gain model applied in the main signal path, preferably in the signal processing unit 2. Therefore, the signal processing unit 2 is operatively connected to the gain unit 5 of the side signal path. The value for the applied gain in the gain unit 5 is, for example, computed as a function of the existing band gains applied in the main signal path. Thereby, at least one band gain of the main signal path is used to determine the value for the gain applied in the gain unit 5.

A further embodiment consists in combining and weighting several band gains of the main signal path in order to determine the value for the gain in the side signal path. It is further proposed to adjust the value for the gain in the side path gain unit 10 to 20 dB lower than the gain in the main path for high gain values of around 50 to 80 dB, but only a few dB lower for low gain values of around 0 to 20 dB. Thus, for high gain settings in the main signal path, as needed for severe hearing losses, the effects of beamformers, noise cancellers, feedback cancellers and an elaborate gain model do not get diminished by the side signal path, where those functions are not implemented. It is to be noted though that the final gain of the main path is preferably used to derive the gain for the side path. This final gain in the main path may already include the effects of e.g. a noise canceller, limiters, etc., albeit with probably higher resolution. Likewise, hearing device users with severe hearing loss do not perceive the group delay anymore at all.

Figure 3:
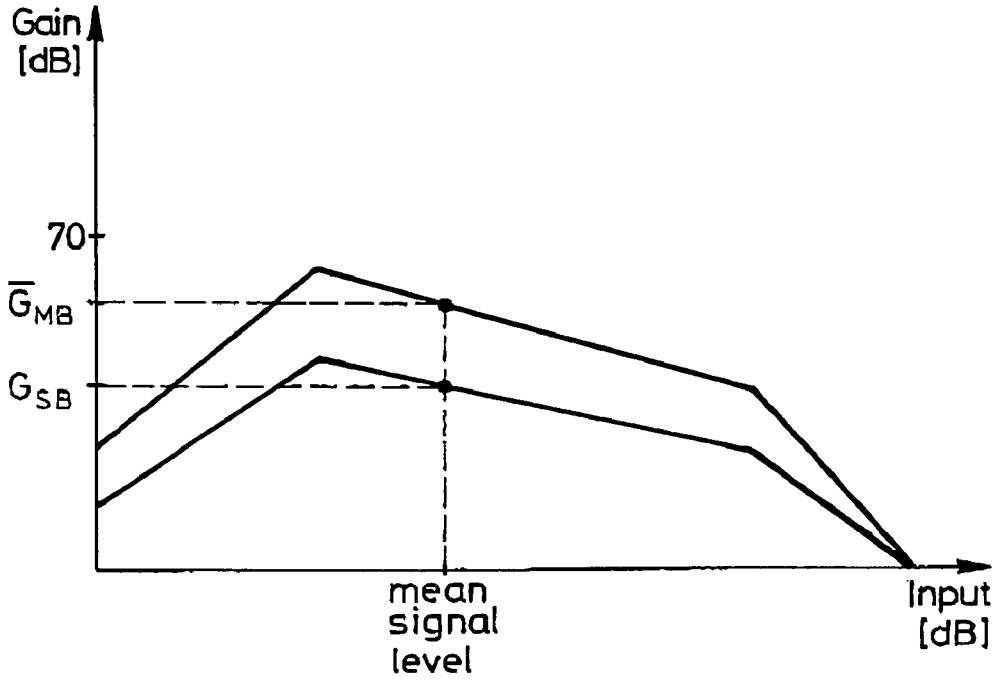

FIG. 3 shows gain as a function of an input level in Decibel to illustrate the adjustment of the gain $G_{SB}$ in the side signal path calculated from one or several band gains of the main signal path for a severe hearing loss. The gain of the side signal path has a relatively slow time constant compared to the rise time of transients, i.e. of first wave fronts. Transients therefore are so fast that they will be treated with a linear gain. In effect, a transient will be heard by the hearing device user via the side signal path without or extremely low group delay. Localization is thus not impeded. Even more, the brain does not perceive the delayed processed signal as a separate echo but fuses it with the undelayed signal.

Figure 4:
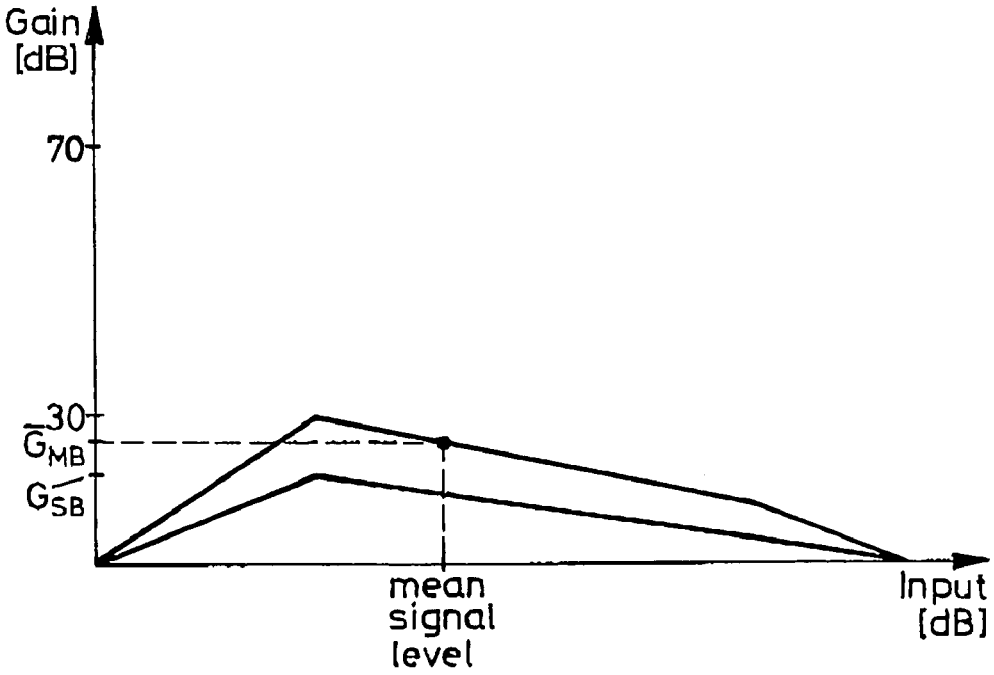

FIG. 4 again shows gain as a function of an input level in Decibel to illustrate the adjustment of the gain $G_{SB}$ in the side signal path calculated from several band gains of the main signal path for a mild hearing loss. In this case, only little gain is applied. A feedback canceller (and its effect) therefore is not needed; likewise beamformers and noise cancellers have only a minor effect. The effect of an elaborate gain model with many bands and sophisticated gain determination is not as well noticable due to the small differences over frequency and input level. In this case, the gain in the side signal path may be much closer to the normal gain and therefore even more significant. This situation also corresponds to a setting provided by a fitter who will listen to an instrument and determine its sound quality.

In the embodiment shown in FIG. 2, a filter unit 7 is additionally provided in the side signal path between the gain unit 5 and the adder unit 6. The filter unit 7 consists of a simple $1^{st}$ or $2^{nd}$ order high pass filter, for example. The filter pole may get fitted to the individual hearing loss of the hearing device user. As a result of such a filter unit 7, the side signal path becomes very similar to a simple single channel analog hearing device regarding group delay and adaptability of the gain function. Only the gain itself is somewhat lower than needed for full loudness restorations. In fact, a further embodiment of the present invention may have a side signal path realized by using analog circuit components while the main signal path is realized by using digital circuit components or by using a digital signal processing unit, respectively.

For the side path, a simple time-domain filter bank in a digital or analog implementation with only a few channels is conceivable as well, possessing also only a very small group delay.

Although the filter unit 7 is only present in FIG. 2 showing a side signal path with an adjustable gain, a corresponding filter unit can also be implemented in the embodiment having a preset value for the gain as shown in FIG. 1.

In order that no overly loud transient may pass the hearing device, a limiting unit 3 is provided to limit the output signal coming from the adder unit 6, i.e. the summation of the signals from the main signal path and the side signal path. In other words, the limiting unit 3, which is inherently a sample based function, is also seen by the side signal path.

It is pointed out that the side signal path is computationally extremely simple. It consists only of the gain unit 5 and possibly of the filter unit 7, being a $1^{st}$ or $2^{nd}$ order high pass filter or a simple time-domain filter bank, and the adder unit 6 to add the signals of the side signal path and the main signal path.

Figure 5:
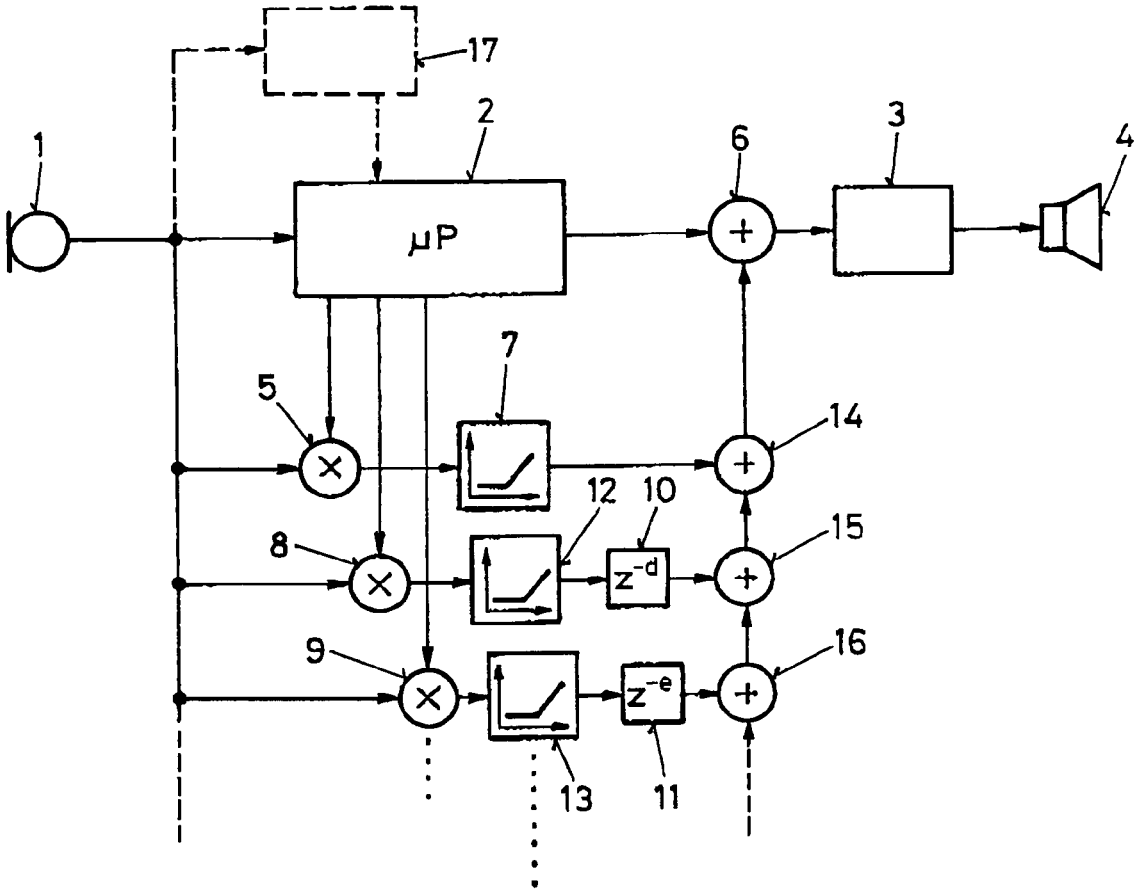

FIG. 5 schematically shows a further embodiment of the present invention in a block diagram in which two further side signal paths are provided each having a further gain unit B or 9, a further filter unit 12 or 13 and a delay unit 10 or 11, respectively, in addition to the side signal unit already provided in the embodiments depicted in FIGS. 1 and 2. The side signal path and the further side signal paths are connected in parallel to the main signal path comprising the signal processing unit 2, i.e. the output signal of the input transducer 1 is fed to the signal processing unit 2, to the gain unit 5 as well as to the further gain units 8 and 9, and the output signal of the main signal path, the side signal path as well as of the further side signal paths are added together to form the input signal for the limiting unit 3.

By providing more than one side signal path, the effect of the precedence effect is improved, especially in case the signal through the further side signal paths get additionally delayed by a small amount, for example by ⅓ to ⅔ of the filter bank delay of the main signal path. Thus in addition to the output signal of the side signal path having no or only little delay and in addition of the output signal of the main signal path, there will be a third, forth, etc. output signal with a delay somewhere in between the zero- or minimum-delay and the maximum-delay output signal. These "in-between" output signals will increase the loudness perception of the first wave front (loudness summation) and thus enhance the precedence effect while keeping the magnitude of the output signals of the side signal path well below the output signal of the main signal path.

In all of the afore-mentioned embodiments of the present invention, a silence detector unit 17 is depicted in dashed lines. The silence detector unit 17 is, on its input side, operatively connected to the input transducer 1 and, on the silence detector unit 17 output side, operatively connected to the signal processing unit 2.

Typical hearing device users are elderly people, often sitting alone in their old age homes. Thus, they are significantly often in quiet environments. In such an environment, the whole sophisticated processing as performed in the main signal path—including a filter bank, beamformers, noise cancellers, an elaborate gain model, a classifier, etc.—is superfluous. A simple silence detector unit 17 may get used to switch off the entire main signal path and leave only the side signal path active. Therefore, the output signal of the input transducer 1 is also fed to the silence detector unit 17 which is, on its output side, connected to the signal processing unit 2 in order to provide information about significant sound activity to the signal processing unit 2. As soon as sound activity drops below a preset level, the power supply to the signal processing unit 2 can be reduced. Thus, the signal processing unit 2 consumes significantly less power, thereby increasing the battery life time considerably. All states within the main signal path get frozen. Thus, the gain in the gain unit 5 in the side signal path gets frozen as well to the value needed for this low input level there, i.e. below the knee point. If sound reappears, the silence detector unit 17 will again switch on the main signal path immediately, for example within the same frame, and all states will continue from where they have been before entering the mute state. The silence detector unit 17 will contain a parametrizable level threshold of preferably 40 dB and a time constant, such that only quiet periods of preferably longer than 5 s will lead to a switch off of the main signal path.

The corresponding function for a silence detector unit 17 can be realized by a so-called ZASTA-(Zero Attack Short Term Averager)-circuit, i.e. a dual slope averager with 0 s rise time and a preset release time of 5 s, for example. The switching may of course get performed in a soft manner, i.e. such that no eventual click is perceivable by the hearing device user.

However, it is expressly pointed out that, although the use of a silence detector unit 17 is explained in connection with embodiments of the invention related to the precedence effect, the functions and advantages of using silent detector unit 17 in connection with a main signal path and a side signal path can be obtained independently of features related to the precedence effect. In other words, a hearing device with a main signal path, in which rather high processing power is needed, and a side signal path, in which rather low processing power is needed, it is possible to significantly reduce overall power consumption in the hearing device by adding a simple silence detector unit 17 to control the main signal path in the sense that the main signal path is switched off while there is little acoustic activity in the acoustic surrounding. Nevertheless, a normal hearing impression can be provided to the hearing device user over the side signal path although this hearing impression might be of lower quality, e.g. a slightly wrong signal level due to the fixed gain. As soon as higher sound activity is detected by the silence detector unit, the main signal path, i.e. the signal processing unit in which high quality and high performance algorithms are processed, is switched on again.

It is pointed out that although there is a loudspeaker—often called receiver in the hearing device technology—depicted in the FIGS. 1, 2 and 5 as output transducer 4, it is as well feasible that other output transducers can be used without leaving the scope of the present invention. Another output transducer might be used for implantable hearing devices having, for example, implementing a direct stimulus of the nerves in the inner ear.

In addition, the present invention can very well be applied to binaural hearing devices which comprise two hearing device parts connected by a wire or wirelessly.

Finally, it is expressly pointed out that the method and the hearing device according to the present invention cannot only be used in connection with a correction of a hearing impairment. In fact, the techniques disclosed can very well be used in connection with any wired or wireless communication device. In this sense, the term "hearing device" must be understood as hearing aid, be it introduced in the ear canal or implanted into a patient, to correct a hearing impairment as well as to any communication device used to facilitate or improve communication.

The invention claimed is:

1. A method to operate a hearing device comprising an input transducer, a signal processing unit and an output transducer, the method comprising the steps of converting an acoustic input signal into a converted input signal, processing the converted input signal in a main signal path in order to obtain a main output signal, supplying the main output signal to an output transducer, processing the converted input signal in a side signal path to obtain a side path output signal, filtering the signal in the side signal path by a high-pass filter or a time-domain filter bank, and superimposing the side path output signal on the main output signal, wherein a group delay of a signal traveling through the side signal path is smaller than a group delay of a signal traveling through the main signal path.

2. The method of claim 1, further comprising the step of adjusting a gain in the side signal path such that an overall gain from the input transducer through the side signal path to the output transducer is approximately equal to one.

3. The method of claim 1, further comprising the step of limiting the main output signal before the output transducer.

4. A method to operate a hearing device comprising an input transducer, a signal processing unit and an output transducer, the method comprising the steps of converting an acoustic input signal into a converted input signal, processing the converted input signal in a main signal path in order to obtain a main output signal, supplying the main output signal to an output transducer, processing the converted input signal in a side signal path to obtain a side path output signal, adjusting a gain, applied to the converted input signal in the side signal path, as a function of a gain applied to the converted input signal in the main signal path, wherein the gain applied to the converted input signal in the side signal path is computed from an existing gain model in the main signal path, and superimposing the side path output signal on the main output signal, wherein a group delay of a signal traveling through the side signal path is smaller than a group delay of a signal traveling through the main signal path.

5. The method of claim 4, wherein the gain applied to the converted input signal in the side signal path is calculated from several or all existing band gains applied in different frequency bands in the main signal path.

6. A method to operate a hearing device comprising an input transducer, a signal processing unit and an output transducer, the method comprising the steps of converting an acoustic input signal into a converted input signal, processing the converted input signal in a main signal path in order to obtain a main output signal, supplying the main output signal to an output transducer, processing the converted input signal in a side signal path to obtain a side path output signal, processing the converted input signal in at least one further side signal path to generate at least one further side path output signal, superimposing the side path output signal on the main output signal, and superimposing the at least one further side path output signal on the main output signal, wherein a group delay of a signal traveling through the side signal path is smaller than a group delay of a signal traveling through the main signal path.

7. The method of claim 6, further comprising the step of filtering an input signal in at least one of the further side signal paths.

8. The method of claim 1 or 6, further comprising the steps of monitoring a level of the converted input signal, switching off the processing of the converted input signal in the main signal path in case the level of the converted input signal is below a preset value.

9. A hearing device comprising a main signal path comprising at least one input transducer to convert an acoustic input signal into a converted input signal, a signal processing unit and an output transducer, wherein the at least one input transducer is operatively connected to the output transducer via the signal processing unit, wherein a side signal path is provided that is, on its input side, fed by the converted input signal and that is, on its output side, operatively connected to an adder unit which is further comprised in the main signal path in between the signal processing unit and the output transducer, said side signal path comprising a gain unit, wherein the side signal path further comprises a high-pass filter unit or a time-domain filter bank, and wherein a group delay of a signal traveling through the side signal path is smaller than a group delay of a signal traveling through the main signal path.

10. The hearing device of claim 9, wherein the main signal path further comprises a limiting unit that is arranged in between the adder unit and the output transducer.

11. The hearing device of claim 9, wherein the gain unit is operatively connected to the signal processing unit.

12. The hearing device of claim 11, wherein a value for a gain, set in the gain unit, is adjustable as a function of a gain of the main signal path.

13. A hearing device comprising a main signal path comprising at least one input transducer to convert an acoustic input signal into a converted input signal, a signal processing unit and an output transducer, wherein the at least one input transducer is operatively connected to the output transducer via the signal processing unit, wherein a side signal path is provided that is, on its input side, fed by the converted input signal and that is, on its output side, operatively connected to an adder unit which is further comprised in the main signal path in between the signal processing unit and the output transducer, said side signal path comprising a gain unit, wherein further side signal paths are provided, each comprising a further gain unit and a delay unit, whereas the converted input signal is fed to the delay unit via the further gain unit, the output of the delay unit being operatively connected to the adder unit, or further adder units.

14. The hearing device of claim 13, wherein at least one of the further side signal path comprises a further filter unit in between the adder unit and the corresponding further gain unit.

15. The hearing device of claim 13, wherein at least one of the further gain units is operatively connected to the signal processing unit.

16. The hearing device of claim 9 or 13, wherein a silence detector unit is provided to which the converted input signal is fed and which is, on its output side, operationally connected to the signal processing unit.

* * * * *

UNITED STATES PATENT AND TRADEMARK OFFICE

CERTIFICATE OF CORRECTION

PATENT NO. : 7,248,710 B2
APPLICATION NO. : 10/772605
DATED : July 24, 2007
INVENTOR(S) : Hans-Ueli Roeck It is certified that error appears in the above-identified patent and that said Letters Patent is hereby corrected as shown below:

ON THE TITLE PAGE ITEM (54): Delete the title "EMBEDDED INTERNET FOR HEARING AIDS" and replace with --METHOD TO OPERATE A HEARING DEVICE AND A HEARING DEVICE--

In the Specifications:
Delete the title "EMBEDDED INTERNET FOR HEARING AIDS" and replace with --METHOD TO OPERATE A HEARING DEVICE AND A HEARING DEVICE--

Column 4, Line 11: Delete the word "on"; replace with the word --an--;
Column 4, line 44: Delete the word "Decibel"; replace with the word --decibel--;
Column 5, line 42: Delete the capital letter "B"; replace in bold the number --8--;
Column 6, line 38: Delete the space between "0" and the letter "s";
Column 6, line 39: Delete the space between "5" and the letter "s";

Signed and Sealed this

Twenty-fifth Day of December, 2007

JON W. DUDAS
*Director of the United States Patent and Trademark Office*